US008895789B2

(12) United States Patent
Fukuya et al.

(10) Patent No.: US 8,895,789 B2
(45) **Date of Patent: *Nov. 25, 2014**

(54) FUEL COMPOSITION FOR USE IN GASOLINE ENGINES

(75) Inventors: Hideto Fukuya, Tokyo (JP); Nobuhiro Okabe, Tokyo (JP); Shinya Sasaki, Tokyo (JP)

(73) Assignee: Shell Oil Company, Houston, TX (US)

( * ) Notice: Subject to any disclaimer, the term of this patent is extended or adjusted under 35 U.S.C. 154(b) by 407 days.

This patent is subject to a terminal disclaimer.

(21) Appl. No.: 13/133,746

(22) PCT Filed: Dec. 11, 2009

(86) PCT No.: PCT/EP2009/066924

§ 371 (c)(1),
(2), (4) Date: Jul. 21, 2011

(87) PCT Pub. No.: WO2010/066876

PCT Pub. Date: Jun. 17, 2010

(65) Prior Publication Data

US 2012/0022304 A1 Jan. 26, 2012

(30) Foreign Application Priority Data

Dec. 11, 2008 (JP) ..... 2008-316148

(51) Int. Cl.
*C10L 1/06* (2006.01)
*C10L 1/16* (2006.01)

(52) U.S. Cl.
CPC ..... *C10L 1/06* (2013.01)
USPC ..... 585/14; 44/300; 208/16; 208/17

(58) Field of Classification Search
USPC ..... 44/300; 585/14; 208/16, 17
See application file for complete search history.

(56) References Cited

U.S. PATENT DOCUMENTS

| | | | | |
|---|---|---|---|---|
| 3,317,621 | A | 5/1967 | Deyoung | 260/668 |
| 4,875,992 | A * | 10/1989 | Hamner | 208/89 |
| 4,990,239 | A | 2/1991 | Derr, Jr. et al. | 208/68 |
| 6,353,143 | B1 * | 3/2002 | Fang et al. | 585/1 |
| 7,563,358 | B2 * | 7/2009 | Stavens et al. | 208/138 |
| 8,273,138 | B2 * | 9/2012 | Bauldreay et al. | 44/307 |
| 2008/0300435 | A1 * | 12/2008 | Cortright et al. | 585/14 |
| 2010/0077655 | A1 * | 4/2010 | Bauldreay et al. | 44/437 |
| 2013/0055626 | A1 * | 3/2013 | Bauldreay et al. | 44/432 |

FOREIGN PATENT DOCUMENTS

| | | | |
|---|---|---|---|
| JP | 2000073073 | 3/2000 | C10L 1/06 |
| JP | 200382367 | 3/2003 | C10L 1/06 |
| JP | 2003096474 | 4/2003 | C10L 1/04 |
| JP | 2003277776 | 10/2003 | C10L 1/08 |
| JP | 2006028493 | 2/2006 | C10L 1/08 |
| JP | 200663264 | 3/2006 | C10L 1/06 |
| JP | 2008127542 | 6/2008 | |
| JP | 2008297436 | 12/2008 | C10G 111/18 |
| JP | 2008297437 | 12/2008 | C10G 11/18 |
| JP | 2008297438 | 12/2008 | B01J 27/19 |

OTHER PUBLICATIONS

PCT Written Opinion (TS8166 PCT) dated Apr. 13, 2010, for Application No. PCT/EP2009/066924.

PCT Written Opinion (TS8167 PCT) dated Apr. 7, 2010, for Application No. PCT/EP2009/066934.

PCT Written Opinion (TS8168 PCT) dated May 27, 2010 for Application No. PCT/EP2009/066936.

* cited by examiner

*Primary Examiner* — Ellen McAvoy

(57) ABSTRACT

A fuel composition for use in gasoline engines which has excellent acceleration characteristics at high speeds and excellent fuel consumption. The fuel composition of this invention for use in gasoline engines satisfies the conditions: (1) the research octane number is not less than 99; (2) the density is in the range of from 0.750 to 0.770 g/cm3; (3) the distillation temperature at 50 vol % distilled is in the range of from 95 to 102° C., the distillation temperature at 90 vol % distilled is in the range of from 160 to 180 ° C., and the distillation end point is in the range of from 180 to 220 ° C.; and (4) the content of aromatic hydrocarbons with 9 or more carbon atoms is in the range of from 15 to 25% by volume, and the indane content is in the range of from 0.5 to 3.0% by volume.

19 Claims, No Drawings

FUEL COMPOSITION FOR USE IN GASOLINE ENGINES

PRIORITY CLAIM

The present application claims priority from PCT/EP2009/066924, filed 11 Dec. 2009, which claims priority from Japanese Application JP 2008-316148, filed 11 Dec. 2008.

This invention relates to a fuel composition for use in gasoline engines as installed in automobiles and the like, and in particular gasoline engines which correspond to Gasoline No. 1 of the JIS standard (JIS K2202).

Various kinds of performance to improve drivability of vehicles and durability of engines are required of fuels for use in the gasoline engines used in automobiles. In order to satisfy these performance requirements, several types of blending component are blended together and prepared whilst taking into account the octane number and distillation characteristics. However, the performance required of a fuel for gasoline engines changes as the social environment changes, so that whenever new demands arise investigations are made of gasoline engine fuel compositions that might apply to them.

For example, in recent years, in consideration of the impact on the environment, there has been a requirement to reduce the vapour pressure and benzene content of gasoline fuels. Gasoline fuel compositions which purport to maintain drivability while satisfying this requirement are disclosed in Japanese Laid-open Patent Specification Nos. 2003-277776 and 2006-63264.

At the same time in recent years, the technology relating to engines has progressed and wide networks of high-speed national roads (the so-called motorways or expressways) have been completed, so that the driving environment for automobiles has also changed. In comparison with previous driving conditions, there are now many instances where an improvement in acceleration characteristics in high-speed areas is required. Japanese Laid-open Patent Specification No. 2003-82367, for example, discloses a fuel additive which has as its main constituent a specified amide compound so as to improve the acceleration response of automobiles.

However, the fuel compositions for use in gasoline engines disclosed in Japanese Laid-open Patent Specification Nos. 203-277776 and 2006-63264, despite having excellent acceleration properties at mainly medium and low speeds, have problems with acceleration properties and fuel consumption at high speeds. Also, in the case of the fuel additive disclosed in Japanese Laid-open Patent Specification No. 2003-82367, costs increase yet no improvement in fuel consumption is evident. Furthermore, there have been problems in that the amount added of additives such as detergents is limited because of an increase in gum due to the fact that they have a high molecular weight.

Therefore, the present invention has as its objective to offer a fuel composition for use in gasoline engines which, without any additional conventional fuel additives, has excellent acceleration characteristics at high speeds and excellent fuel consumption.

The fuel composition of this invention for use in gasoline engines satisfies the conditions: (1) the research octane number is not less than 99; (2) the density is in the range of from 0.750 to 0.770 g/cm$^3$; (3) the distillation temperature at 50 vol % distilled is in the range of from 95 to 102° C., the distillation temperature at 90 vol % distilled is in the range of from 160 to 180° C., and the distillation end point is in the range of from 180 to 220° C.; and (4) the content of aromatic hydrocarbons with 9 or more carbon atoms is in the range of from 15 to 25% by volume, and the indane content is in the range of from 0.5 to 3.0% by volume.

The fuel composition of this invention for use in gasoline engines may also contain in the range of from 4 to 10% by volume of a fraction with a distillation characteristic of from 160 to 230° C. obtained from fluid catalytic cracking apparatus.

The aforementioned fraction may also have a content of aromatic hydrocarbons with 9 or more carbon atoms of amount not less than 80% by volume, and an indane content of amount not less than 20% by volume. What is meant by an indane is such as 2,3-dihydroindene (indane) optionally substituted by at least one functional group which is a hydrocarbon such as an alkyl group, preferably a $C_1$- to $C_4$-alkyl group.

In the present invention, there is no particular restriction on the number of carbons in an alkyl group bonded to the indane or on the number of groups, but it is preferable if the number of carbon atoms in the total indane molecule is not more than 12. If the number of carbon atoms is more than 12, the heavy fractions in the blending component of the gasoline engine fuel obtained will increase and the distillation end point will increase, which is not desirable. As specific examples of indanes, mention may be made of 2,3-dihydroindene (indane), 5-methylindane, 4-methylindane, 1,2-dimethylindane, 1,3-dimethylindane, 1,4-dimethylindane, 1,5-dimethylindane, 1,6-dimethylindane, 1,7-dimethylindane, 1,4,5-trimethylindane, 1,4,6-trimethylindane, 2,4,5-trimethylindane, and 2,4,6-trimethylindane.

With the fuel composition of this invention for use in gasoline engines, it is possible, without needing to add any additional fuel additives, to improve the acceleration characteristics and fuel consumption at high speeds by incorporating in the range of from 15 to 25% by volume of aromatic hydrocarbons with not less than 9 carbons and in the range of from 0.5 to 3.0% by volume of an indane. If the amount of aromatic hydrocarbons with not less than 9 carbon atoms and the amount of indane are less than the aforementioned ranges, the effect of improving the high-speed acceleration performance and fuel consumption will not be achieved, so that it is preferable to increase as far as possible the range at which the necessary conditions can be maintained for the gasoline-engine fuel composition. Preferably the amount of aromatic hydrocarbons with not less than 9 carbon atoms is not less than 18% by volume, and the indane content is not less than 1% by volume. The fuel compositions of the present invention exhibit improved high-speed acceleration performance and fuel consumption.

The fuel composition of the present invention for use in gasoline engines can be obtained by incorporating as a blending component in the range of from 4 to 10% by volume of a fraction with a distillation characteristic of from 160 to 230° C. obtained from a fluid catalytic cracking apparatus, and in particular a fraction which has a content of aromatic hydrocarbons with 9 or more carbon atoms of amount not less than 80% by volume, and an indane content of amount not less than 20% by volume. The blending component which has a distillation characteristic of in the range of from 160 to 230° C., a content of aromatic hydrocarbons with 9 or more carbons of amount not less than 80% by volume, and an indane content of amount not less than 20% by volume (hereinafter referred to as LLCO) can be obtained by further distillation of light cycle oil corresponding to the kerosene fraction known as middle distillates (distillation characteristic not more than 380° C., hereinafter referred to as LCO). This LLCO has a high research octane number (hereinafter RON) of at least 93, and also contains many indanes. It can therefore improve the acceleration properties at high speeds, and because the pervolume calorific value is at least 11% higher than commercial gasoline fuels, it is possible to improve fuel consumption. Also, whilst containing many heavy aromatic hydrocarbons, it contains hardly any existent gum in comparison with fractions obtained from reformates of similar distillation characteristics, so that it has the advantage of having no effect on the amounts of other additives such as detergents.

Further, LCO hitherto has been used as a blending component for heavy oil "A", but as it has a low cetane number there have been constraints on its use for diesel-engine heavy oil "A", so that there is an advantage in relation to effective use of such fractions.

The proportion of LLCO in the blend can be suitably set in the range of from 4 to 10% by volume so that the characteristics of the gasoline-engine fuel composition will be within the desired ranges, but given that its distillation characteristics are heavier than for gasoline-engine fuel compositions, in order to satisfy the JIS standard for automobile gasolines (JIS K 2202), it is necessary in particular to limit the proportion in the blend so that the distillation temperature at 90 vol % distilled (T90) is not more than 180° C. and further that the distillation end point (EP) is not more than 220° C. It is also necessary for there not to be any impact on practical performance as an automotive gasoline engine fuel, and taking this into account the preferred blend proportion is in the range of from 4 to 7% by volume.

In the case where LLCO is obtained by fractionation of ordinary LCO, the content of aromatic hydrocarbons with not less than 9 carbon atoms is in the amount of from approximately 70 to 90% by volume, and the indane content is in the range of from about 15 to 25% by volume. From the standpoint of high-speed acceleration properties and fuel consumption, it is preferable if the LLCO cut temperature is made higher, but if the distillation end point exceeds 230° C., there will be undesirable problems in that the fuel composition for use in gasoline engines will be made excessively heavy, or the proportion that can be blended in will be restricted.

The fuel composition of this invention for gasoline engines can be manufactured by mixing in the range of from 4 to 10% by volume of LLCO with ordinary gasoline blending components. As examples of ordinary gasoline blending components, mention may be made of the following.

"Desulphurised Light Naphtha"

This is a blending component obtained by desulphurisation of a naphtha obtained from a crude oil atmospheric distillation apparatus, and then by separation into low boiling point fractions by means of distillation.

"Isomerised Gasoline"

This is a blending component obtained by isomerisation of the aforementioned desulphurised light naphtha.

"Catalytic Reformate"

This is a blending component obtained by desulphurisation of a naphtha obtained from a crude oil atmospheric distillation apparatus and reforming of the remaining heavy fraction separated off by distillation of the aforementioned desulphurised light naphtha, using for example a catalytic reforming method such as Platforming.

"Debenzenated Light Catalytic Reformate"

This is a blending component obtained by separating the aforementioned catalytic reformate into fractions with a boiling point lower than benzene by means of distillation.

"Raffinate Fraction"

This is a blending component obtained by further distillation of a heavy catalytic reformate obtained by fractionation in the form of fractions with a high boiling point by means of distillation from the aforementioned catalytic reformate, and by taking the fractions obtained by separation of fractions which contain benzene therefrom as the remainder from which the benzene is extracted and removed by using, for example, a solvent such as Sulfolane.

"Catalytic Reformates with 7 Carbon, 8 Carbon, or 9 or More Carbon Atoms"

These are blending components obtained by further distillation of a heavy catalytic reformate obtained by fractionation in the form of fractions with a boiling point higher than benzene by means of distillation from the aforementioned catalytic reformate, and fractionation into fractions that contain mainly aromatics with 7 carbons, aromatics with 8 carbons and aromatics with 9 or more carbons.

"Catalytically Cracked Gasoline"

This is a blending component obtained by catalytically cracking heavy oil.

"Thermally Cracked Gasoline"

This is a blending component obtained by thermally cracking heavy oil.

"Light Catalytically Cracked Gasoline and Desulphurised Heavy Catalytically Cracked Gasoline"

These are blending components obtained by distillation of the aforementioned catalytically cracked gasoline obtained by catalytic cracking of heavy oil to separate it into fractions with a low boiling point and fractions with a high boiling point. In the case of the light fractions, the blending component is the result of treating the foul-smelling light sulphur compounds such as mercaptan by sweetening methods such as the Merox method. In the case of the heavy fractions, the blending component is the result of removing the sulphur component while ensuring that the reduction in the octane number through olefin hydrogenation is minimised, by using a selective desulphurisation method such as Prime-G+.

"Light Thermally Cracked Gasoline and Heavy Thermally Cracked Gasoline"

These are blending components obtained by separation into fractions with a low boiling point and fractions with a high boiling point by distilling the aforementioned thermally cracked gasoline obtained by thermally cracking heavy oil.

"Alkylate"

This is a blending component obtained by addition of lower olefins (alkylation) obtained as a by-product from catalytic cracking apparatus to hydrocarbons such as isobutane.

"Butane/Butylene Fraction"

This is a blending component obtained by refining petroleum gases obtained as a by-product from apparatus such as atmospheric distillation apparatus, naphtha desulphurisation apparatus, catalytic reforming apparatus or catalytic cracking apparatus.

"Oxygenates Such as Alcohols or Ethers"

Mention may be made specifically of, for example, methanol, ethanol and propanol for alcohols. As examples of ethers mention may be made of MTBE (methyl tertiary butyl ether) and ETBE (ethyl tertiary butyl ether).

The types of gasoline blending components used are selected as appropriate to conditions such as the make-up of the apparatus at the refinery. There is no need for all the types of blending component to be mixed in. Consequently, the proportion of any types not used is 0% by volume. Also, when the sulphur content of the LLCO obtained by fractionation of LCO is high, it is possible to carry out, as needed, a desulphurisation treatment such as hydrorefining or adsorption desulphurisation.

EXAMPLES

LCO obtained from a catalytic cracking apparatus was further separated in a distillation apparatus into light fractions and heavy fractions. A light-fraction LLCO with a distillation characteristic of initial boiling point to 230° C. was obtained. A fuel composition for use in gasoline engines was compounded by blending the LLCO in a commercial premium gasoline (PG). Table 1 shows the characteristics of the LLCO, and Table 2 shows the characteristics of fuel compositions for use in gasoline engines which included the LLCO (Embodiments 1 and 2 and Comparative Example 1). Table 2 also shows, in the form of Comparative Example 2, the characteristics of the PG used in the compounding.

The methods of measurement of the properties shown in Tables 1 and 2 were as follows.

Density

Measured in accordance with JIS K 2249 "Crude Oil and Petroleum Products—Determination of Density and Density/Mass/Volume Conversion Tables".

Distillation Characteristic

Measured in accordance with JIS K 2254 "Petroleum Products—Distillation Test Methods".

Octane Number

Measured in accordance with the method for determination of research octane number of JIS K 2280 "Petroleum Products—Fuel Oils—Determination of Octane Number and Cetane Number, and Method for Calculation of Cetane Index".

Composition/Aromatics

Measured in accordance with JIS K-2536-2 "Petroleum Products—Method for Determination of Constituents. Part 2: Determination of All Components by Gas Chromatographs".

Total Calorific Value

Measured in accordance with JIS K 2279 "Crude Oil and Petroleum Products—Method for Determination of Calorific Value and Method for Estimation by Calculation".

Fuel Consumption

Measured by the TRIAS test method on a chassis dynamo. The test was performed in JCO8 mode (hot start) after sufficient running in warm air. The fuel consumption was calculated from the amount of exhaust gases produced during the test by using a carbon balance equation, and the rate of improvement in fuel consumption was expressed as a relative value, taking the commercial PG fuel as a basis.

Acceleration Properties

Three time spans were set up at intervals of 10 km/h, from 70 km/h to 100 km/h, and the times to reach the respective vehicle speeds were measured on a chassis dynamo. The improvement or deterioration in acceleration properties was evaluated on the basis of the acceleration times for the commercial PG fuel. In the table, "Good acceleration relative to the standard base fuel" was expressed as "O" (pass), "Same acceleration relative to the standard base fuel" was expressed as "Same", and "Poor acceleration relative to the standard base fuel" was expressed as "X" (fail).

TABLE 1

| | | LLCO |
|---|---|---|
| RON | | 95.0 |
| Density | g/cm³ | 0.8626 |
| Distillation | | |
| IBP | ° C. | 166.5 |
| T10 | ° C. | 178.0 |
| T30 | ° C. | 183.5 |
| T50 | ° C. | 189.0 |
| T70 | ° C. | 195.0 |
| T90 | ° C. | 202.5 |
| EP | ° C. | 225.0 |
| Composition | | |
| C9+ aromatics | Vol % | 82.3 |
| Indanes | | |
| Indane (2,3-dihydroindene) | Vol % | 1.0 |
| Methylindane | Vol % | 5.3 |
| Dimethylindane | Vol % | 10.3 |
| Trimethylindane | Vol % | 4.2 |
| Total | Vol % | 20.8 |
| Total calorific value | J/cm³ | 39100 |

TABLE 2

| | | Emb. 1 | Emb. 2 | Comp. Ex. 1 | Comp. Ex. 2 |
|---|---|---|---|---|---|
| PG | Vol % | 93 | 96 | 85 | 100 |
| LLCO | Vol % | 7 | 4 | 15 | |
| RON | | 99.3 | 99.4 | 98.9 | 99.6 |
| Density | g/cm³ | 0.7597 | 0.7578 | 0.7708 | 0.7494 |
| Distillation | | | | | |
| IBP | ° C. | 29.5 | 29.5 | 30.5 | 30.0 |
| T10 | ° C. | 48.5 | 46.5 | 50.5 | 45.5 |
| T30 | ° C. | 71.5 | 70.0 | 77.5 | 67.5 |
| T50 | ° C. | 100.5 | 97.5 | 108.0 | 94.0 |
| T70 | ° C. | 122.0 | 117.5 | 136.0 | 113.5 |
| T90 | ° C. | 168.0 | 163.0 | 184.5 | 155.0 |
| EP | ° C. | 196.5 | 189.5 | 218.5 | 175.0 |
| Composition | | | | | |
| CP+ aromatics | Vol % | 20.1 | 18.1 | 25.4 | 15.4 |

TABLE 2-continued

| | | Emb. 1 | Emb. 2 | Comp. Ex. 1 | Comp. Ex. 2 |
|---|---|---|---|---|---|
| Indanes | | | | | |
| Indane(2,3-dihydroindene) | Vol % | 0.3 | 0.2 | 0.3 | 0.2 |
| Methylindane | Vol % | 0.4 | 0.2 | 0.8 | 0.0 |
| Dimethylindane | Vol % | 0.7 | 0.4 | 1.5 | 0.0 |
| Trimethylindane | Vol % | 0.3 | 0.2 | 0.6 | 0.0 |
| Total | Vol % | 1.7 | 1.0 | 3.2 | 0.2 |
| Total calorific value | $J/cm^3$ | 35580 | 35520 | 36000 | 35200 |
| Fuel consumption | % | 1.3 | 1.1 | — | Base |
| Acceleration properties | | ○ | ○ | — | Base |

As shown in Table 2, it was found that in the case of Embodiments 1 and 2, which had a greater amount of aromatic hydrocarbons with not less than 9 carbon atoms and a greater amount of indanes than the commercial PG (Comparative Example 2), irrespective of the fact that they did not contain any extra additives other than those in the commercial PG, the acceleration properties at high speeds (70 to 100 km/h) and fuel consumption improved.

Also, for the compounded fuel composition for use in gasoline engines to satisfy the JIS standard for gasoline (JIS K 2202) it is necessary to regulate the blend proportions so that T90 is not more than 180° C. and the EP is not more than 220° C., but, as Table 2 shows, Comparative Example 1, which includes 15% by volume of LLCO, the distillation temperature at 90 vol % distilled (T90) was found to exceed the 180° C. which is the JIS K 2202 standard. On the other hand, when the proportion of LLCO in the blend was not more than 10% by volume, there was no impact on practical performance, and it was confirmed that it was possible to compound a fuel composition for use in gasoline engines that satisfied the JIS standard. Furthermore, by making the proportion of LLCO in the blend 7% by volume, fuel consumption was improved by 1.3%, and the acceleration properties were also found to be improved.

We claim:

1. A fuel composition for use in gasoline engines, having a research octane number of not less than 90, a density in the range of from 0.740 to 0.760 $g/cm^3$, wherein said density is measured in accordance with JIS K 2249, a distillation temperature at 50 vol % distilled is in the range of from 95 to 105° C., a distillation temperature at 90 vol % distilled is in the range of from 160 to 180° C., and a distillation end point is not more than 220° C., comprising aromatic hydrocarbons with 9 or more carbon atoms in the range of from 15 to 25% by volume, and an indane content in the range of from 0.5 to 3.0% by volume.

2. The fuel composition of claim 1 comprising a fraction with a distillation characteristic of 160 to 230° C. obtained from a fluid catalytic cracking apparatus in a range of 4 to 10% by volume.

3. The fuel composition of claim 2 wherein said fraction comprises aromatic hydrocarbons with 9 or more carbon atoms in an amount of not less than 80% by volume, and an indane content of not less than 20% by volume.

4. The fuel composition of claim 1 wherein the indane is selected from the group consisting of 2,3-dihydroindene, 5-methylindane, 4-methylindane, 1,2-dimethylindane, 1,3-dimethylindane, 1,4-dimethylindane, 1,5-dimethylindane, 1,6-dimethylindane, 1,7-dimethylindane, 1,4,5-trimethylindane, 1,4,6-trimethylindane, 2,4,5-trimethylindane, and 2,4,6-trimethylindane.

5. The fuel composition of claim 4 wherein the indane is 2,3-dihydroindene.

6. The fuel composition of claim 5 wherein the 2,3-dihydroindene is substituted by at least one hydrocarbon group.

7. The fuel composition of claim 6 wherein the at least one hydrocarbon group is an alkyl group.

8. The fuel composition of claim 7 wherein the alkyl group is a $C_1$ to $C_4$ alkyl group.

9. The fuel composition of claim 1 wherein the amount of aromatic hydrocarbons with 9 or more carbon atoms is not less than 18% by volume and the indane content is not less than 1% by volume.

10. A gasoline fuel composition comprising aromatic hydrocarbons with 9 or more carbon atoms in an amount of 15 to 25% by volume, and an indane content in a range of 0.5 to 3.0% by volume.

11. The gasoline fuel composition of claim 10 comprising, in a range of 4 to 10% by volume, a fraction with a distillation characteristic of 160 to 230° C. obtained from a fluid catalytic cracking apparatus.

12. The gasoline fuel composition of claim 11 wherein said fraction comprises aromatic hydrocarbons with 9 or more carbon atoms in an amount of not less than 80% by volume, and an indane content of not less than 20% by volume.

13. The gasoline fuel composition of claim 12 wherein the indane is selected from the group consisting of 2,3-dihydroindene, 5-methylindane, 4-methylindane, 1,2-dimethylindane, 1,3-dimethylindane, 1,4-dimethylindane, 1,5-dimethylindane, 1,6-dimethylindane, 1,7-dimethylindane, 1,4,5-trimethylindane, 1,4,6-trimethylindane, 2,4,5-trimethylindane, and 2,4,6-trimethylindane.

14. The gasoline fuel composition of claim 13 wherein the indane is 2,3-dihydroindene.

15. The gasoline fuel composition of claim 14 wherein the 2,3-dihydroindene is substituted by at least one hydrocarbon group.

16. The gasoline fuel composition of claim 15 wherein the at least one hydrocarbon group is an alkyl group.

17. The gasoline fuel composition of claim 16 wherein the alkyl group is a $C_1$ to $C_4$ alkyl group.

18. The gasoline fuel composition of claim 10 wherein the amount of aromatic hydrocarbons with 9 or more carbon atoms is not less than 18% by volume and the indane content is not less than 1% by volume.

19. The gasoline fuel composition of claim 10 with a research octane number of not less than 90, a density in the range of from 0.740 to 0.760 g/cm$^3$, wherein said density is measured in accordance with JIS K 2249, a distillation temperature at 50 vol % distilled is in the range of from 95 to 105° C., a distillation temperature at 90 vol % distilled is in the range of from 160 to 180° C., and a distillation end point is not more than 220° C.

* * * * *